United States Patent [19]

Kawakami et al.

[11] 3,942,029

[45] Mar. 2, 1976

[54] ELECTROSTATIC TRANSDUCER

[75] Inventors: Hirotake Kawakami; Kantaro Takada, both of Tokyo, Japan

[73] Assignee: Sony Corporation, Tokyo, Japan

[22] Filed: July 17, 1974

[21] Appl. No.: 489,400

[30] Foreign Application Priority Data

July 23, 1973 Japan ..... 48-82821

[52] U.S. Cl. ..... 307/88 ET; 179/111 E

[51] Int. Cl.[2] ..... H04R 19/00

[58] Field of Search ..... 307/88 ET; 129/111 E; 340/173, 2

[56] References Cited

UNITED STATES PATENTS

| | | | |
|---|---|---|---|
| 2,924,970 | 2/1960 | Samsel et al. | 340/173.2 |
| 3,118,022 | 1/1964 | Sessler et al. | 179/111 E |
| 3,851,183 | 11/1974 | Lewiner et al. | 307/88 ET |
| 3,894,199 | 7/1975 | Tamura et al. | 179/111 E |

FOREIGN PATENTS OR APPLICATIONS

| | | | |
|---|---|---|---|
| 348,573 | 5/1931 | United Kingdom | 179/111 E |

*Primary Examiner*—Stanley M. Urynowicz, Jr.
*Attorney, Agent, or Firm*—Hill, Gross, Simpson, Van Santen, Steadman, Chiara & Simpson

[57] ABSTRACT

An electrostatic transducer comprising a vibrating plate or electret diaphragm which has a monocharge on its surface and including a pair of back electrodes clamping the electret therebetween and including an electrically conductive electrostatic shield covering the back electrodes so as to increase the fidelity and life of the transducer.

8 Claims, 7 Drawing Figures

ELECTROSTATIC TRANSDUCER

BACKGROUND OF THE INVENTION

1. Field of the Invention

This invention relates generally to electrostatic transducers and in particular to an electrostatic transducer which has improved electrical and acoustical properties.

2. Description of the Prior Art

Electrostatic transducers according to the prior art require a driving power source and a high voltage DC source for applying a DC bias. These devices utilize a high voltage DC power source which is complicated in construction. For example, generally a thin high polymer film is used as the vibrating plate; and in order to obtain electrical conductivity on the vibrating plate, a metal film, as for example of aluminum, gold, titanium, or other suitable metal, is formed on the high polymer film by vacuum evaporation, or alternatively, a surface active agent is coated on to the high polymer film. This makes the vibrating plate very expensive and also adds weight to it so that it becomes very heavy. The high voltage DC source is usually obtained by rectifying commercially available AC power. An oscillator driven by a battery can be used to obtain a high voltage DC output; or alternatively, a vocal signal can be rectified to obtain a DC signal. However, high voltage DC sources require a number of circuit elements and require a separate voltage source thus resulting in safety, maintenance, cost and other problems.

In order to avoid these defects at the present time, transducers utilizing electrets as the diaphragm are widely used. The electret diaphragm requires no DC voltage source circuit; and thus, the entire circuit can be simplified. A conductive layer is formed on one surface of the electret (high polymer) film and a capacitor is formed by the conductive layer and a back electrode between which the electret film is clamped and the diaphragm or electret film becomes heavy due to the conductive layer formed thereon. This results that the electro-acoustic high frequency response does not have high fidelity.

Recently, a uni-electret diaphragm formed by charging a high polymer film with a monocharge has been proposed. This type of diaphragm is very light because it requires no conductive layer; and thus, the electro-acoustic conversion can be performed with high fidelity over a wide frequency range from low to high frequencies with such device. However, since the uni-electret diaphragm carries a monocharge, it is strongly affected by external charges and its stored charge will also be rapidly reduced as compared with a diaphragm having a conductive layer. Thus, transducers of the prior art utilizing uni-electret diaphragms have very low electric-acoustic conversion efficiency after being used for long periods of time.

SUMMARY OF THE INVENTION

The present invention provides an improved electrostatic transducer utilizing an electret diaphragm which is covered with an electrostatic shielding means.

It is an object of the invention to provide a novel electrostatic transducer of an improved type.

Another object of the invention is to provide an electrostatic transducer which does not require an external DC bias source and which is driven by a simple circuit.

Yet another object of the invention is to provide an electrostatic transducer which utilizes an electret diaphragm having no conductive layer and which has superior electric-acoustic characteristics.

A further object of the invention is to provide an electrostatic transducer utilizing an electret diaphragm and which has electrical shielding means so as to prevent the decrease of electrical charges carried on the electret diaphragm and such that the diaphragm can be used for long periods of time.

Yet a further object of the invention is to provide an electrostatic transducer having a uni-electret diaphragm and including a static shielding means, wherein the shielding means is maintained at the same potential as that of a back plate electrode so as to provide positive shielding for the uni-electret diaphragm.

Still a further object of the invention is to provide an electrostatic transducer in which the secondary winding of a transformer provides the shield for the electrostatic transducer with a simple electrical connection.

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
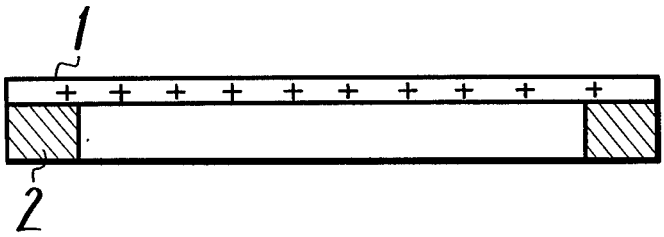
FIG. 1 is a cross-sectional view illustrating an embodiment of an electret diaphragm used in the electrostatic transducer according to the invention.

FIG. 1 illustrates an electret diaphragm which comprises one of the main elements of the invention and which is provided with a monocharge of positive or negative potential with the particular electret illustrated in FIG. 1 having a positive potential. The electret diaphragm 1 is made of a thin high polymer film having a thickness of about 3 to 12 microns and its surface charge density is about, for example, 1 to $3 \times 10^{-9}$ C/cm$^2$. The electret diaphragm 1 is bonded about its outer periphery to a support ring 2 with a suitable epoxy thermo-setting bonding agent and the diaphragm 1 is attached so that uniform tension exists in the diaphragm. The supporting ring 2 serves as a spacer for the diaphragm.

Figure 2:
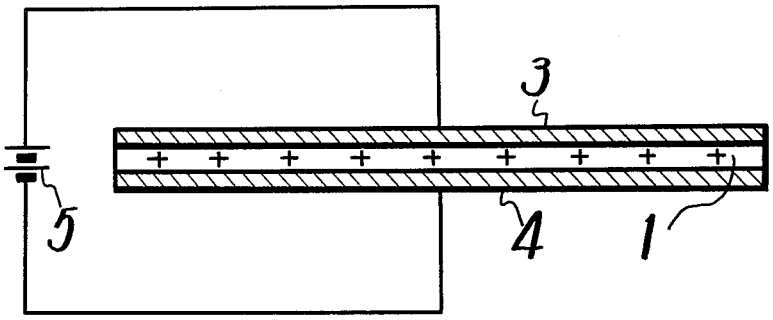
FIG. 2 is a sectional view illustrating the method of manufacturing the electret diaphragm.

FIG. 2 illustrates a method of manufacturing an electret diaphragm having a monocharge of uniform surface density. A pair of plate-shaped metal electrodes 3 and 4 made of gold, nickel, or other suitable material are brought in contact with opposite sides of the thin high polymer film 1 made of polyethylene, polyester, polypropylene, or other suitable material, and a DC voltage source 5 has its opposite terminals connected respectively to the electrodes 3 and 4 as shown. The temperature of the film is gradually increased to 120°C for 10 minutes; and when the temperature of the film 1 has reached 120°C, an electrical field of about 30KV/cm is connected to the electrodes 3 and across the film 1 and is applied to the film 1 for about 25 minutes. Then the film 1 and electrodes are gradually cooled for 15 minutes with the electric field being maintained on the electrodes. When the electric field is then removed, the film 1 will be permanently charged with a monocharge of a positive or negative sign depending upon the intensity of the applied electric field, the material of the electrodes 3 and 4 as well as the heating temperature.

Figure 3:
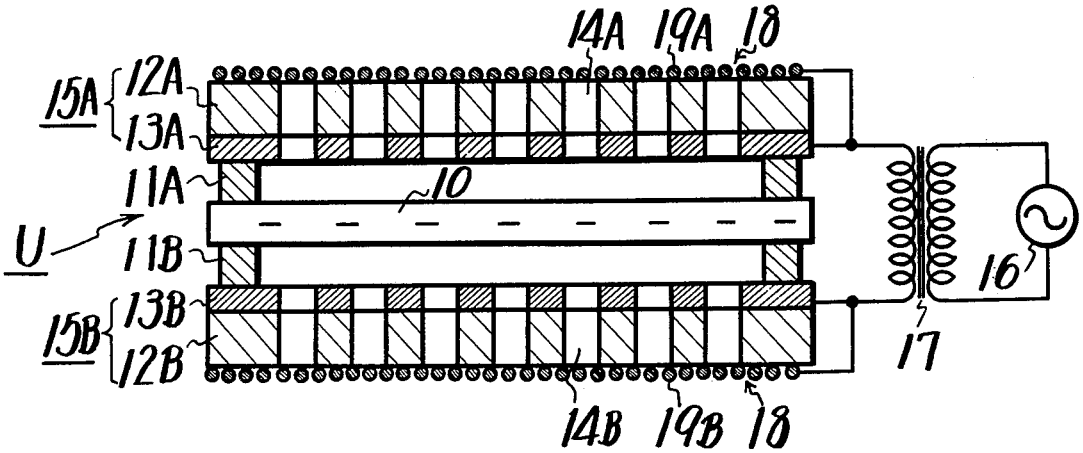
FIG. 3 is a cross-sectional view through an electrostatic transducer according to the invention.

FIG. 3 illustrates an embodiment of the electrostatic transducer of the invention mounted in an operative environment. An electret diaphragm 10 having a negative surface charge and which might have a thickness of 3 microns has its outer edges bonded to annular spacer and support rings 11A and 11B which are mounted on opposite sides thereof with epoxy thermo-setting bonding agent. Push-pull back electrodes 15A and 15B, respectively, are attached to the spacer rings 11A and 11B on sides opposite the electret 10. Back electrode 15A comprises a plate 12A made of high polymer resin and an electrically conducting layer 13A attached to the surface of the plate 12A adjacent the support ring A. The push-pull back electrode 15B comprises a plate of high polymer resin 12B to which an electrical conductive layer 13B and the opposite side of the layer 13B is attached to the support ring 11B.

A plurality of openings 14A are formed through the plate 12A and the layer 13A and a plurality of aligned openings 14B are formed through the plate 12B and the layer 13B. These openings 14A and 14B provide air holes to allow air to be driven by the diaphragm 10.

The conductor layers 13A and 13B are respectively attached to the plates 12A and 12B by coating a conductive material such as silver paint or carbon graphite, for example, by the silk-screen method, or a metal such as aluminum, gold, or nickel coated by a vacuum evaporation method onto the plates 12A and 12B, respectively. An alternative method of making the layers 13A and 13B is by making them of metal sheets such as aluminum, stainless steel, or brass, and then punching the openings 14A and 14B through them. The electrostatic transducer U thus formed is connected to a signal source 16 through a transformer 17 which has its secondary connected to the conductive layers 13A and 13B of the back electrodes 15A and 15B, respectively. The electret diaphragm 10 will be vibrated in response to the signal from the signal source 16.

According to the present invention, electrostatic shielding means 18 are formed on the sides of the back electrodes 15A and 15B away from the diaphragm 10 and the electrostatic shielding means 18 provides electrostatic shielding for the electret diaphragm 10. The electrostatic shielding means may be formed of, for example, a conductive metal mesh made of fibers of stainless steel, brass, or carbon, or may be formed of an electrical conductive woven material. In the example illustrated in FIG. 3, metal mesh members 19A and 19B are respectively connected to the plates 12A and 12B as shown. The secondary of the transformer 17 is connected to the electrical conducting shielding means 19A and 19B as shown. The secondary winding of the transformer 17 is connected to the back electrodes 15A and 15B as shown and the metal meshes 19A and 19B are electrically connected to the corresponding back electrodes 15A and 15B.

Figure 4:
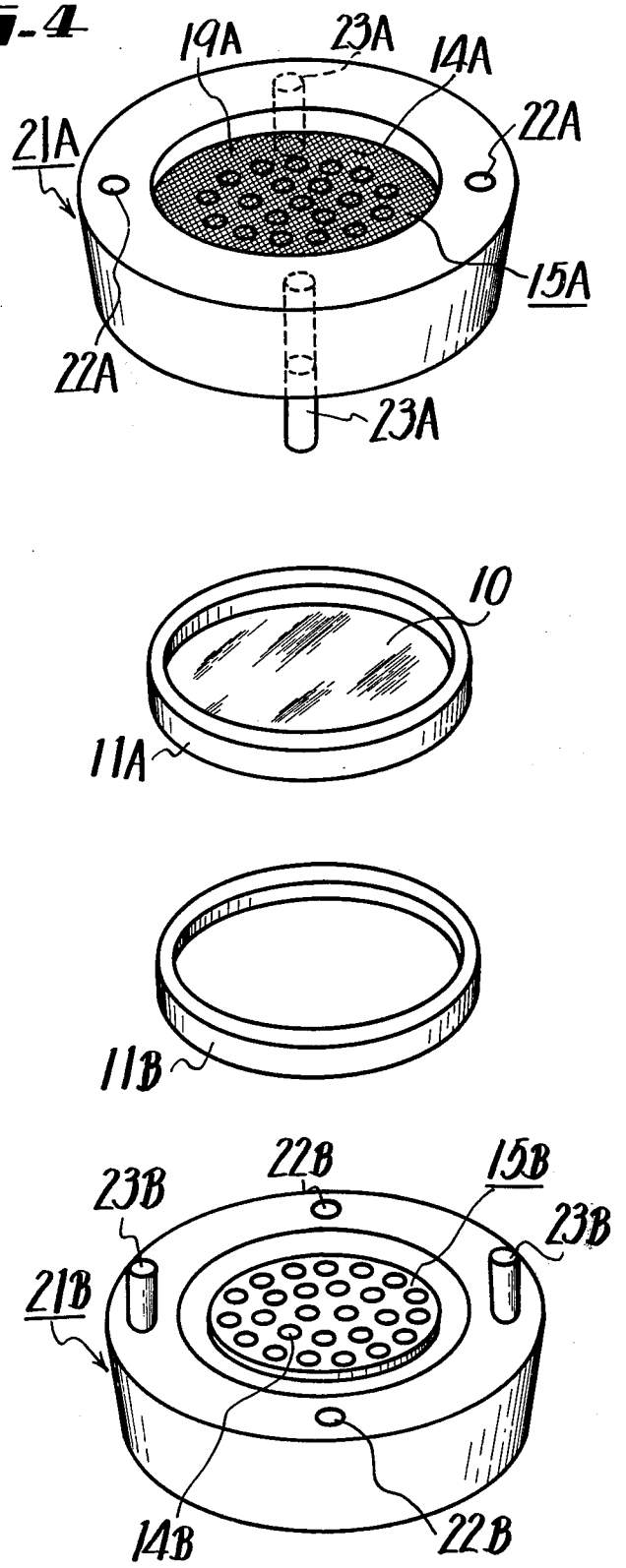
FIG. 4 is a perspective exploded view illustrating a practical embodiment of the electrostatic transducer of the invention.
Figure 5:
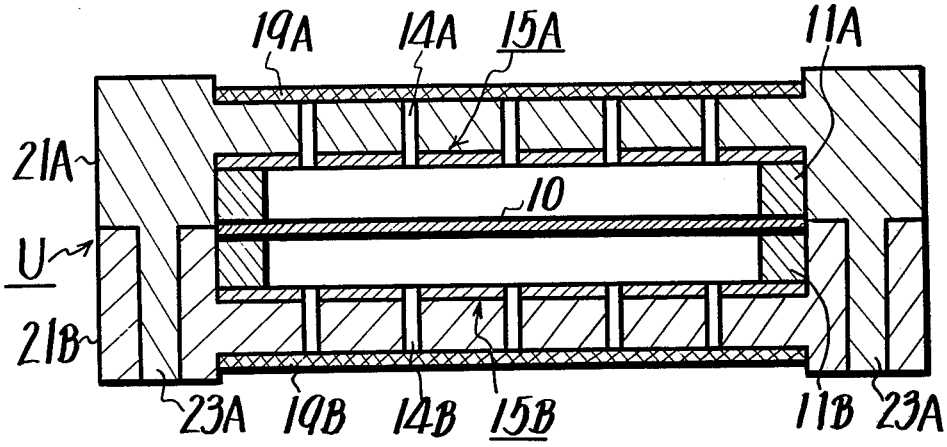
FIG. 5 is a cross-sectional view illustrating the electrostatic transducer of FIG. 4 and in the assembled relationship.

FIG. 4 is an exploded view of a practical embodiment of the electrostatic transducer of the invention. A first support or spacer ring 11A has the electret 10 attached to its lower side relative to FIG. 4, and a second support or spacer ring 11B is attached to the second side of the electret 10 to form the diaphragm. The back electrodes 15A and 15B which include the disk-shaped insulating plates 12A and 12B through which the air holes 14A and 14B are formed are attached to opposite sides of the spacer rings 11A and 11B. The metal mesh 19A is attached to the upper surface relative to FIG. 4 of the insulating plate 12A and a corresponding electrically shielding conductive layer 19B is attached to the surface of the insulating plate 12B as shown in FIG. 5. A pair of mating cylindrical frame members 21A and 21B are integrally formed with the plates 12A and 12B as shown in FIG. 5.

As shown in FIG. 4, a pair of aperatures 22A are drilled through the frame 21A on its opposite sides in the peripheral portion. A pair of projecting pins 23A are inserted or formed on the lower surface of the frame 21A as shown in FIG. 4 and extend downwardly therefrom as shown. In the frame member 21B, mating openings 22B are formed so as to receive the pins 23A therein and a pair of pins 23B are mounted in the member 22B and extend upwardly and are receivable in the openings 22A of the frame member 21A.

In assembling the transducer according to the invention, the ring 11A with the electret diaphragm 10 attached thereto is inserted into the frame member 21A as illustrated in FIG. 5, and then the spacer ring 11B is inserted into the frame member 21B and the frame members 21A and 21B are brought together such that the pins 23A extend into the openings 22B of the frame member 21B and the pins 23B of the frame member 21B extend into the openings 21A of the frame member 21A so that the assembled structure is as shown in FIG. 5.

The electrostatic transducer according to the invention may be made with an electret diaphragm 10 having either positive or negative surface charge and the vibrating plate thus formed can be very thin and the mass of the vibrating system will be very small. The electrostatic transducer according to the invention has superior response characteristics, great physical strength, and outstanding tone quality. The electrostatic transducer is very simple in construction but has superior response characteristics and does not require DC bias from an external high voltage DC source which substantially simplifies the structure.

The electrostatic shielding means 18 comprising the metallic mesh-like layers 19A and 19B are mounted on the back electrodes 15A and 15B on sides opposite to those facing the electret diaphragm 10 and the surface charge density of the electret diaphragm 10 will be maintained for a very long period of time and can be prevented from being attenuated which will substantially prolong its lifetime.

Experiments have demonstrated that superior electrostatic shielding is accomplished in the present invention without decreasing the acoustic characteristics.

This may be understood by considering that due to electrostatic induction produced by the electret diaphragm 10 having a negative charge, for example, a charge of opposite sign, or a positive charge will be induced in the back plate electrodes 15A and 15B and in the metal mesh 19A and 19B, respectively. The back electrodes 15A and 15B may be considered to be grounded through a support member (insulator) for attaching the transducer U to a suitable support. Although the support member is not shown, it would be made of an insulating material, but the resistance value of the insulating material would not be infinitive and the mesh members 19A and 19B would be connected to ground through the support member. This results in the conductive meshes 19A and 19B serving as electrostatic shields with the results that the charge in the electret 10 will not be effected by external charges outside of the transducer unit U.

Figure 6:
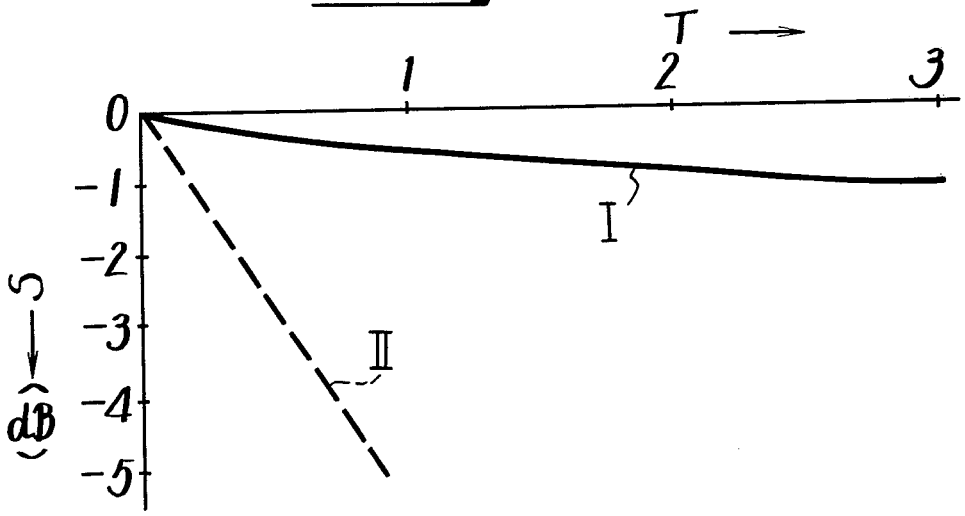
FIG. 6 is a graph illustrating the sensitivity-time characteristics of the electrostatic transducer of the invention as well as the characteristics of the prior art devices.

FIG. 6 illustrates the improved sensitivity lifetime of the present invention. Experiments conducted have shown that the relative sensitivity S in dB remains high for long periods of time. The ordinate represents the relative sensitivity and the abscissa represents the interval T in months. In FIG. 6, curve I is a plot for an electrostatic transducer according to the invention such as illustrated in FIG. 5 and having the conductive mesh 19A and 19B providing electrostatic shielding. The curve II illustrates a transducer having an electrostatic transducer with an electret diaphragm but in which the shielding meshes 19A and 19B have been left out.

As is apparent from FIG. 6, the electrostatic transducer according to the invention, changes in sensitivity very slowly over a long time period as compared to those of the prior art illustrated by curve II. Thus, the electret having the shielding mesh members 19A and 19B illustrated in FIG. 5 have much greater sensitivity for longer periods of time than the prior art devices.

The connections of the conductive meshes 19A and 19B to the back electrodes 15A and 15B, respectively, are through the secondary winding of the transformer 17 and the connection is very simple. Although in the embodiment illustrated in FIG. 3, the electret 10 is provided with a negative charge, it is to be realized that the same results can be obtained with an electret diaphragm having a positive charge.

Figure 7:
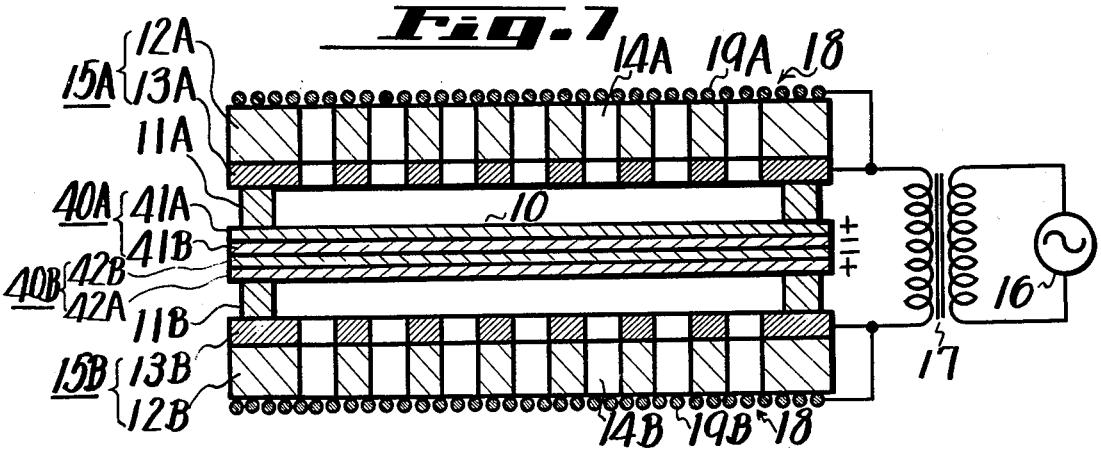
FIG. 7 is a cross-sectional view through a modification of the invention.

FIG. 7 is a modification of the invention illustrated in FIG. 3, wherein the electret 10 is formed of a composite sandwich layer having four different layers and in which the electret diaphragm 10 comprises two electret diaphragms 40A and 40B superimposed such that a monocharge exists at least on its surface. The electret diaphragms 40A and 40B consist of high polymer films 41A and 42A and metal layers 41B and 42B consisting of aluminum and bonded to surfaces of the high polymer films 41A and 42A. The metal layers 41B and 42B are mounted adjacent each other and are bonded together. The remaining construction of the back plates and spacing rings 11A and 11B of the embodiment illustrated in FIG. 7 is the same as that illustrated in FIG. 3 and the electrostatic shielding 18 comprising the conductive meshes 19A and 19B are respectively connected to the back electrodes 15A and 15B as shown.

In the embodiment illustrated in FIG. 7, attenuation of the surface charge of the electret diaphragm is prevented by the shielding means 19A and 19B and the transducer is usable for long periods of time. In the embodiment illustrated in FIG. 7, even though the mass of the electret diaphragm is relatively large, the surface charge of the electret diaphragm lasts for a long period of time. It is to be realized that the present invention can be utilized either in a speaker or microphone.

Although the invention has been described with respect to preferred embodiments, it is not to be so limited as changes and modifications may be made which are within the full intended scope as defined by the appended claims.

We claim as our invention:

1. An electrostatic transducer comprising:

a. an electret diaphragm having a monocharge at its surface;

b. an electrode mounted adjacent said electret diaphram and spaced a predetermined distance therefrom;

c. electrically conductive shielding means for electrostatically shielding said electret diaphragm; and d. means for connecting said electrically conductive shielding means with said electrode to maintain said electrically conductive shielding means and electrode at the same potential.

2. An electrostatic transducer comprising:

a. an electret diaphragm made of a film having a monocharge;

b. a first back electrode having a number of air holes and mounted adjacent one surface of said electret diaphragm and spaced a predetermined distance therefrom, said first back electrode consisting of a conductive body on one side adjacent said electret diaphragm and an insulating body on the side opposite said electret diaphragm and supporting said conductive body;

c. a second back electrode having a number of air holes and adjacent the other surface of said electret diaphragm, said second back electrode consisting of a second conductive body on one side adjacent said electret diaphragm and a second insulating body on the side opposite said electret diaphragm and supporting said second conductive body;

d. a pair of frames supporting said first and second back electrodes, respectively;

e. means for attaching said frames together;

f. electrically conductive mesh-like shielding means covering the surfaces of said insulating bodies, and g. means for electrically connecting said shielding means to said first and second back electrodes to maintain them at the same potential.

3. An electrostatic transducer as claimed in claim 2, in which said means for attaching consists of a recess formed in one of said frames and a mating projection extending from the other frame and received in the recess of said one frame.

4. An electrostatic transducer comprising:

a. an electret diaphragm formed of a film having a monocharge thereon;

b. a pair of back electrodes mounted adjacent said electret diaphragm and spaced a predetermined distance therefrom;

c. electrically conductive shielding means covering the surface of said pair of back electrodes, air holes formed in said shielding means and said pair of back electrodes, and further comprising means for connecting said shielding means with said back electrodes to maintain said shielding means and back electrodes at the same potential.

5. An electrostatic transducer as claimed in claim 4, in which each of said back electrodes consists of an insulating plate with a plurality of air holes and a conductive body disposed on one surface of said insulating plate, and said shielding means disposed on the other surface of said insulating plate.

6. An electrostatic transducer as claimed in claim 4, in which said shielding means is an electrically conductive mesh.

7. An electrostatic transducer as claimed in claim 4 further comprising a transformer for transferring an acoustic signal, with the secondary winding of said transformer connected to said shielding means and said back electrodes, respectively.

8. An electrostatic transducer according to claim 4, wherein said electret diaphragm consists of four layers attached together with the middle two layers having the same charge of a first polarity and the outer two layers having the same charge of the opposite polarity.

* * * * *